US006658893B1

(12) United States Patent
Mealey

(10) Patent No.: US 6,658,893 B1
(45) Date of Patent: Dec. 9, 2003

(54) SYSTEM AND METHOD FOR LIQUEFIED PETROLEUM GAS RECOVERY

(75) Inventor: W. Brent Mealey, Calgary (CA)

(73) Assignee: Propak Systems Ltd., Airdrie (CA)

( * ) Notice: Subject to any disclaimer, the term of this patent is extended or adjusted under 35 U.S.C. 154(b) by 0 days.

(21) Appl. No.: 10/244,612

(22) Filed: Sep. 17, 2002

(30) Foreign Application Priority Data

May 30, 2002 (CA) ..... 2388266

(51) Int. Cl.[7] ..... F25J 3/02; F25J 3/00
(52) U.S. Cl. ..... 62/620; 62/619; 62/621
(58) Field of Search ..... 62/617, 619, 620, 62/621

(56) References Cited

U.S. PATENT DOCUMENTS

| | | | | |
|---|---|---|---|---|
| 4,617,039 A | | 10/1986 | Buck | 62/26 |
| 4,895,584 A | | 1/1990 | Buck et al. | 62/29 |
| RE33,408 E | * | 10/1990 | Khan et al. | 62/621 |
| 5,771,712 A | | 6/1998 | Campbell et al. | 62/621 |
| 5,799,507 A | | 9/1998 | Wilkinson et al. | 62/621 |
| 6,070,430 A | * | 6/2000 | McNeil et al. | 62/620 |
| 6,311,516 B1 | * | 11/2001 | Key et al. | 62/619 |

FOREIGN PATENT DOCUMENTS

| | | | |
|---|---|---|---|
| CA | 1249769 | 2/1989 | 162/113 |
| CA | 1288682 | 9/1991 | 162/113 |
| CA | 2223042 | 1/2001 | |

* cited by examiner

*Primary Examiner*—William C. Doerrler
(74) *Attorney, Agent, or Firm*—Shoemaker and Mattare

(57) ABSTRACT

An improved process for recovery of liquefied petroleum gas from a raw natural gas feed stream, capable of achieving ultra high propane recovery yields, thereby separating substantially all of the propane and heavier hydrocarbon components from a predominantly methane and ethane feed gas stream. The process includes steps to liquefy all of the propane and heavier components and part of the methane and ethane components by cooling, condensing, and absorption. The residual feed gas containing the methane and ethane components, being the final gaseous product stream. The liquefied portion of the feed is separated and then fractionated in a distilling unit to produce a propane and heavier product stream. The distilling unit overhead vapors are cooled and condensed in two steps to provide reflux for the top of the deethanizer and for the feed gas absorption.

11 Claims, 1 Drawing Sheet

SYSTEM AND METHOD FOR LIQUEFIED PETROLEUM GAS RECOVERY

FIELD OF THE INVENTION

This invention relates in general to liquefied petroleum gas recovery and, in particular to improved recovery of liquefied petroleum gas from a raw natural gas feed stream in a cryogenic turbo expander plant.

BACKGROUND OF THE INVENTION

Propane markets have driven strong demands in the industry for increasing efficiency in the recovery of liquefied petroleum gas. Efficiency in the recovery of liquefied petroleum gas from a raw natural gas feed stream can be measured by the propane recovery yield relative to the capital cost and energy consumption in the recovery process.

To recover propane and heavier hydrocarbon components from a raw natural gas stream, the propane and heavier hydrocarbon components are absorbed and/or liquefied and separated from the more volatile methane, ethane and inert components of the raw natural gas stream. A cryogenic turbo expander plant expends the potential energy of the pressurized inlet raw natural gas, and in some cases, external energy in the form of mechanical refrigeration, to cool and partly condense the raw inlet gas stream. Indirect heat exchange, primarily upstream of the turbo expander, may be used to assist in cooling the inlet raw natural gas stream. In addition, mechanical refrigeration may also be used to assist in the cooling of the inlet gas. As the inlet gas stream cools the heavier, less volatile hydrocarbon components condense first. A two phase separator is provided to separate the condensed liquid phase from the gaseous phase. The remaining more volatile components still in the vapor phase, are fed to the turbo expander. At the turbo expander, the potential energy of the pressurized gas stream is expended to produce mechanical work. This mechanical work is typically utilized to compress residue gas prior to the residue gas exiting the cryogenic plant, or, alternatively, to compress the inlet raw natural gas stream, increasing the potential energy of the inlet raw natural gas. The pressure and enthalpy of the gas is reduced across the turbo expander turbine, thus causing the gas to further cool (to cryogenic temperatures) and condense. As a result, the more volatile components, including a portion of the methane and ethane components condense. Typically, at this stage, greater than 90% of the propane contained in the inlet stream has condensed. Down stream of the turbo expander, a fractionation distillation column is applied in an attempt to strip the more volatile components from the liquid phase to produce a propane and heavier hydrocarbon liquid product stream. In addition, the same fractionation distillation column can be adapted to absorb and/or rectify the propane and heavier components from the gaseous phase, in order to produce an overhead gaseous predominately methane and ethane, product stream. To achieve propane recovery levels typically in excess of 90% recovery yield, a second cold reflux distillation absorber column is applied.

Although liquefied petroleum gas recovery processes capable of high propane recovery levels have been disclosed, the rate of return for the recovery yield has not been economical. Therefore, industry demands for ultra high recovery have not been met with an economical solution. The competitiveness of the petroleum industry has steadily brought about recent design evolutions, thus increasing plant design targets for propane recovery yields. Typically, recent plant designs have targeted approximately 95% propane recovery.

Exemplary cryogenic expander plants and processes are disclosed in Canadian Patent Nos. 1,288,682 (U.S. Pat. No. RE33408), 1,249,769 (U.S. Pat. No. 4,617,039) and 2,223,042 (U.S. Pat. No. 5,771,712) and U.S. Pat. Nos. 5,799,507, and 6,311,516.

Canadian Patent No. 1,288,682 to Khan et al. teaches the utilization of a second cold reflux distillation absorber column, referred as a direct heat exchanger, to absorb additional propane from residual vapor phase on the discharge of the turbo expander. Khan et al. teach that increased percentages of propane and heavier hydrocarbon components can be recovered by contacting the vapor from a gaseous feed stream with at least a portion of the liquefied overhead from the deethanizer.

U.S. Pat. No. 4,617,039 to Loren L. Buck teaches a similar process to recover additional propane from the expander outlet vapor. Buck teaches that the overhead vapor from the deethanizer column is partly condensed and then the liquid condensate is combined with the vapor from the partially condensed feed gases in the deethanizer feed separator which acts as an absorber.

U.S. Pat. Nos. 5,771,712, 5,799,507, and 5,799,507, and 6,311,516. U.S. Pat. No. 6,311,516 disclose other process arrangements applying a similar second cold reflux distillation absorber column.

These processes suffer from characteristics that physically or economically limit propane recovery capability. The increased energy input required to achieve higher levels of propane recovery makes these processes uneconomical. Many of these processes are inherently expensive on a capital cost basis while others require a larger capital expenditure in the attempt to achieve ultra high propane recovery yield. For example, in many processes, expensive stainless steel construction of piping and equipment is required, instead of carbon steel, for cryogenic operation. Still other processes are highly complex and require multiple indirect heat exchangers. These characteristics negatively affect overall recovery efficiency in attempting to achieve ultra high propane recovery yield.

SUMMARY OF THE INVENTION

It is an object of an aspect of the present invention to provide an improved cryogenic turbo expander plant process for recovery of liquefied petroleum gas (LPG) (ie. propane and heavier hydrocarbons), as a liquid product, from a raw natural gas feed stream. In a particular aspect of the present invention, the improved cryogenic turbo expander plant realizes an improved efficiency of LPG recovery in relation to associated capital cost and energy consumption.

In an aspect of the present invention, there is provided a process for recovery of liquefied petroleum gas from a feed stream. The process includes:

passing the feed stream through an indirect heat exchanger;

separating the feed stream into a first vapor fraction and a first liquid fraction;

transferring the first liquid fraction to the indirect heat exchanger;

transferring the first vapor fraction to a direct heat exchanger absorber column;

transferring the first liquid fraction to a distilling unit;

distilling the first liquid fraction in the distilling unit to yield a second vapor fraction and a second liquid fraction;

cooling the second vapor fraction in the indirect heat exchanger;

separating the second vapor fraction into a third vapor fraction and a third liquid fraction;

returning at least a portion of the third liquid fraction to the distilling unit;

passing the third vapor fraction through the indirect heat exchanger, at least a portion of the third vapor fraction condensing to a liquid phase;

decreasing pressure of the third vapor fraction such that at least a portion of the liquid phase flashes;

transferring the third vapor fraction to the direct heat exchanger absorber column such that the third vapor fraction mixes with the first vapor fraction, yielding a fourth vapor fraction and a fourth liquid fraction;

transferring the fourth liquid fraction to the indirect heat exchanger;

transferring the fourth liquid fraction to the distilling unit to distill the fourth liquid fraction; and transferring thee fourth vapor fraction to the indirect heat exchanger, such that, the feed stream exchanges heat with the first liquid fraction, the fourth vapor fraction, and the fourth liquid fraction, all four streams being in parallel. Also, the third vapor fraction exchanges heat with the fourth vapor fraction and the fourth liquid fraction, all three streams being in parallel and the second vapor fraction exchanges heat with, the fourth vapor fraction and the fourth liquid fraction, all three streams being in parallel. Heat is also exchanged between the feed stream and the fourth liquid fraction, after the fourth liquid fraction has exchanged first with the third vapor fraction, and then with the second vapor fraction.

In one aspect, the present invention provides a process with a calculated propane recovery level of about 99.96% with a marginal increase in capital cost, and a decrease in energy consumption compared to prior art processes. Advantageously, recovery of the same level of LPG is possible with lower capital cost or lower energy consumption or both , in comparison to the prior art processes. The economic balance between a lower capital cost plant, lower energy consumption, or higher LPG recovery is different for each particular application.

In another aspect of the present invention, the first and second section of the indirect heat exchanger are incorporated into one plate-fin exchanger up to a plant capacity of about $7.0\times10^6$ std $m^3$/d. Advantageously, this reduces the number of exchangers and reduces interconnecting piping, supports, foundations, and plot spacing. This also reduces the number of cold boxes used for insulating exchangers and interconnecting piping.

In another aspect, heat is exchanged in parallel in all of the streams, rather than in series or in only some of the streams. This provides the ability to exchange additional heat (energy) in the indirect heat exchangers, since temperature approach pinches between the cooling and heating streams are inhibited by applying the parallel heat exchange method within the indirect heat exchanger which distributes the heat transfer with a more linear temperature profile. In turn, recovery levels are increased relative to energy input, thus improving process efficiency. Alternatively, energy input is decreased for a targeted recovery level.

Advantageously, there is less overall capital cost for the construction of the plant since less expensive carbon steel can be utilized, in lieu of stainless steel for the deethanizer column, and the overhead condenser system (ie. deethanizer overhead separator, deethanizer overhead pumps, piping, etc).

BRIEF DESCRIPTION OF THE DRAWINGS

The invention will be better understood with reference to the drawing in which.

DETAILED DESCRIPTION OF THE PREFERRED EMBODIMENTS

Figure 1:
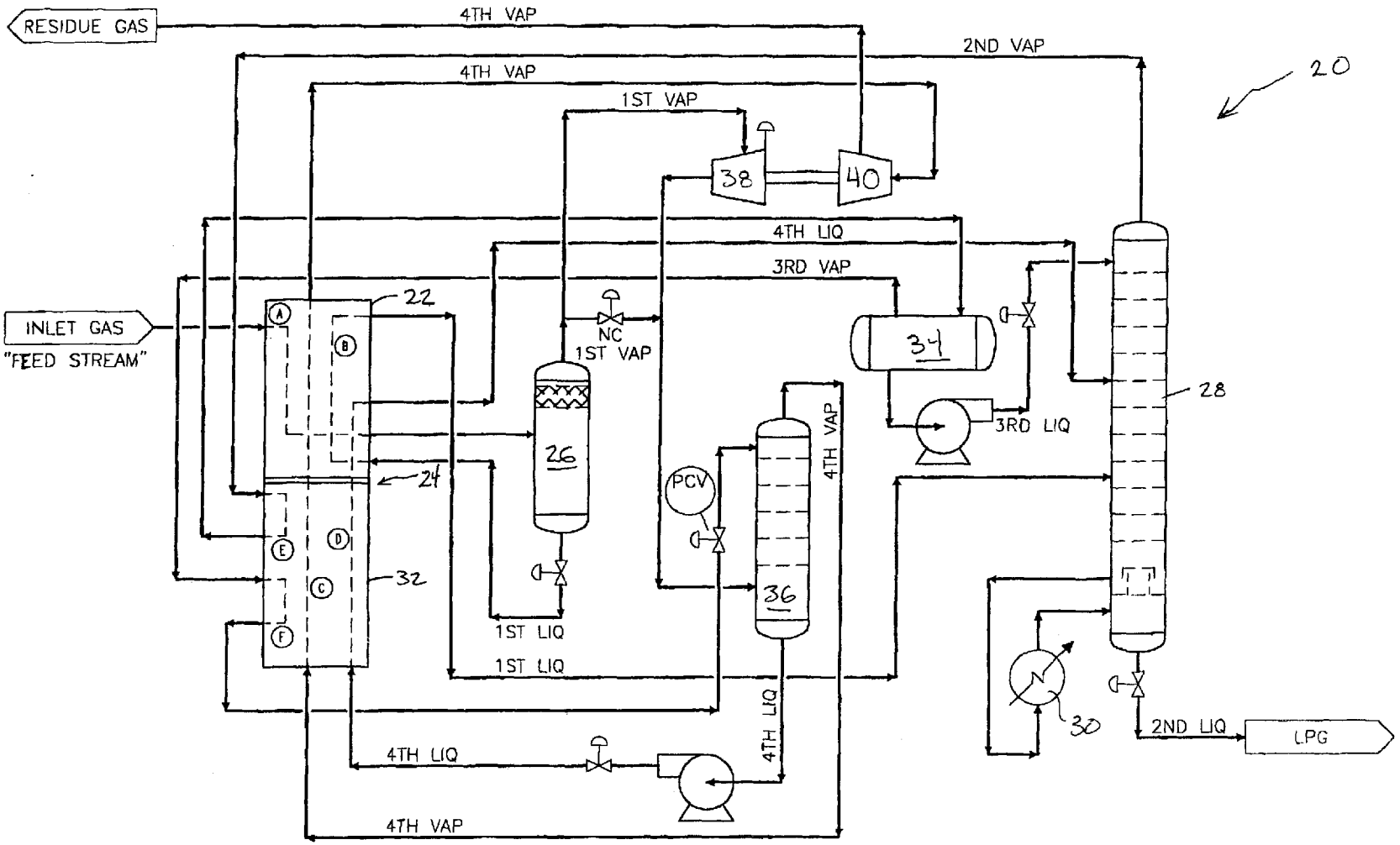
FIG. 1 is a diagram of a cryogenic natural gas processing plant according to an embodiment of the present invention.

The feed stream gas composition to the cryogenic expander plant varies depending on the source. For example, gas sources include natural gas wells, natural gas gathering systems or pipeline transmission systems, or refinery/petrochemical off-gases. Also, the gas contents are dependent on the source and can include, for example, other gases in various concentrations, such as hydrogen, helium, nitrogen, and carbon dioxide. Possible feed stream contaminants include hydrogen sulfide and mercury. Commonly, water is present in the feed stream.

Prior to transferring the feed stream to the subject Cryogenic Turbo Expander Plant, the feed stream is treated to substantially remove contaminants in order to meet product specifications, and to protect the equipment in the plant. Water is removed from the feed stream in order to inhibit hydrate formation and freezing in the plant, and in order to meet product specifications. Additionally, carbon dioxide is removed from the feed stream in order to inhibit solid formation and freezing in the plant, and in order to meet product specifications.

Reference is now made to FIG. 1, which illustrates a preferred embodiment of the cryogenic turbo expander plant indicated generally by the numeral 20. For exemplary purposes, the cryogenic turbo expander plant 20 processes the feed stream detailed in Table 1. In the present embodiment, the feed stream pressure is 5957 kPa absolute and the temperature is 45.5° C. As will be understood by those of skill in the art, typical feedstream pressures generally range from about 4000 kPa to about 8300 kPa, and the temperature generally ranges from about 0° C. to about 55° C. The outlet pressure for the residue gas is 2530 kPa(a). Typical residue gas pressures range from about 1500 kPa to about 3100 kPa, however further compression and cooling may be desired to reach product specifications. External mechanical refrigeration is not necessary in the present embodiment due to the available plant pressure drop. For each application, the optimum operating temperatures and pressures at various locations in the process depend on the feed stream composition, plant inlet/outlet conditions (i.e. temperature and pressure), and the desired product recovery levels, as would be understood by those of skill in the art.

TABLE 1

Example Feed stream Composition

| Component | mole % |
|---|---|
| Nitrogen | 0.998 |
| Carbon dioxide | 0.100 |
| Methane | 80.532 |
| Ethane | 10.764 |
| Propane | 4.461 |
| Iso-butane | 0.639 |
| n-butane | 1.188 |
| iso-pentane | 0.490 |
| n-pentane | 0.314 |
| hexane | 0.325 |
| heptane | 0.135 |
| octane | 0.045 |
| nonane | 0.008 |
| decane | 0.002 |
| Total | 100.000 |

The feed stream enters the subject cryogenic turbo expander plant 20, and is first cooled to −16.5° C. in the first section 22 of the indirect heat exchanger 24, which partially condenses the stream. The cooled feed stream is a two-phase stream which is then separated into a first vapor fraction and a first liquid fraction in the expander feed separator 26. The first liquid fraction is level controlled to the first section 22 of the indirect heat exchanger 24, causing a pressure drop to 2310 kPa(a) and thereby cooling to −33° C. across the level control valve, due to the Joule-Thompson effect. The first liquid fraction is heat exchanged with the feed stream in the indirect heat exchanger 24, and is thereby heated to 41° C., while providing part of the cooling of the feed stream. The heated first liquid fraction is transferred from the indirect heat exchanger 24 to a reboiled deethanizer distillation column 28, as a lower feed thereto. The deethanizer distillation column 28 operates at 2193 kPa(a) and includes bottom reboiler 30 with a bottom reboiler temperature of 82.6° C. The feed liquids to the deethanizer distillation column 28 are fractionated in the deethanizer distillation column 28, into a second vapor fraction which comes off the top of the deethanizer distillation column 28, and a second liquid fraction which comes off the bottom of the deethanizer distillation column 28.

The second vapor fraction is removed from the overhead of the deethanizer distillation column, and is then cooled to −34.4° C. in the second section 32 of the indirect heat exchanger 24, which partially condenses the second vapor fraction. The cooled and condensed second vapor fraction is then separated into a third vapor fraction and a third liquid fraction, in the deethanizer overhead separator 34. Next, the third liquid fraction is refluxed and pumped back to the deethanizer distillation column 28, as a top reflux feed thereto. The third vapor fraction is further cooled to −71.5° C. in the second section 32 of the indirect heat exchanger 24, and is subsequently substantially liquefied (condensed). The substantially condensed third vapor fraction is then pressure controlled to the top section of an absorber column, referred to herein as a direct heat exchanger 36, which operates at 1792 kPa(a). As the stream pressure drops across the pressure control valve the liquid portion of the partially condensed third vapor fraction flashes and cools to −75.7° C. due to the Joule-Thompson effect. In the present embodiment the first section 22 and second section 32 of the indirect heat exchanger are incorporated into one plate-fin exchanger.

The deethanizer distillation column 28 operating pressure, in the present embodiment, is 2134 kPa(a). The deethanizer distillation column 28 operating pressure is at least slightly higher than the pressure in the direct heat exchanger 36, for transfer of the third vapor fraction. Other considerations such as the operating temperature, the deethanizer feed composition, and plant pressure drop affect the desired deethanizer distillation column 28 pressure. In the present embodiment, the deethanizer pressure is "substantially higher" than the direct heat exchanger 36. The term "substantially higher" is used to describe a pressure differential deliberately greater than the pressure to overcome equipment and pipe pressure losses. Deliberately operating the deethanizer distillation column 28 at a substantially higher pressure, allows a greater amount of the second vapor fraction to condense at the deethanizer overhead separator 34 operating temperatures above −40° C. This is a 5.5 degree centigrade margin from the known −45.5° C. minimum allowable design for carbon steel equipment construction.

There is increased condensing of the second vapor fraction, at a set temperature. A larger volume of third liquid fraction is created, which in turn increases the deethanizer reflux ratio. This improves the rectification/separation of the propane component from the more volatile residual methane and ethane components in the deethanizer overhead separator 34 third vapor fraction. The overall propane recovery level is thereby improved. In the present embodiment, the amount of propane in the third vapor fraction is only 0.025 mole The first vapor stream fraction from the expander feed separator 26 is fed to the expander turbine 38, where it is expanded by a drop in pressure from the expander feed separator pressure of about 5900 kPa to 1827 kPa(a) across the expander turbine blades, and thereby cooling to −64° C. Cooling and expansion of the first vapor fraction causes partial condensation of the first vapor fraction. Cooling of the stream is a result of the Joule-Thompson effect, and as a result of a decrease in the enthalpy of the stream, since the stream creates work on the expander turbine 38 and mechanically drives the expander brake compressor 40. Next, the expanded and condensed first vapor fraction is transferred to the bottom of the direct heat exchanger 36. Here the vapor portion of the partially condensed first vapor fraction is directly and counter-currently contacted with the liquid portion of the partially condensed third vapor fraction. The direct contact of the two phases causes evaporative cooling by liquid methane and ethane transferring back to the vapor phase. The direct heat exchanger absorber column operates at 1792 kPa(a). The liquids rectify the vapor portion of the partially condensed first vapor fraction, thereby absorbing additional propane and heavier hydrocarbons. The direct heat exchanger 36 produces a fourth vapor fraction at −74.9° C., and a fourth liquid fraction at −65.6° C.

The fourth liquid fraction is removed from the bottom of the direct heat exchanger 36, and transferred to the second section 32 of the indirect heat exchanger 24, providing part of the cooling for the third vapor fraction, and the second vapor fraction. Next the fourth liquid fraction is further heated in the first section 22 of the indirect heat exchanger 24, providing part of the cooling for the feed stream. The fourth liquid fraction is thereby heated to −6.1° C., and partially vaporized. The partially vaporized fourth liquid fraction is then transferred to the deethanizer distillation column 28 as an upper mid section feed thereto. The fourth liquids are fractionated with the first liquid fraction in the deethanizer distillation column 28, forming the second vapor fraction and a second liquid fraction.

The second liquid fraction is removed as the recovered liquefied petroleum gas (LPG) (ie. propane and heavier hydrocarbons) product from the bottom of the deethanizer distillation column 28. In an exemplary embodiment, the propane recovery level is 99.96 mole %. Thus substantially all of the propane is recovered. Recovery of the butane and heavier component is substantially 100%.

The fourth vapor fraction is removed from the top of the direct heat exchanger 36, and transferred to the second section 32 of the indirect heat exchanger 24 to provide part of the cooling for the third vapor fraction, and then the second vapor fraction. The fourth vapor fraction is then further heated in the first section 22 of the indirect heat exchanger 24 to provide part of the cooling for the feed stream. The fourth vapor fraction is thereby heated to 41.1° C. The heated fourth vapor fraction is then compressed to 2565 kPa(a) in the expander brake compressor 40. The fourth vapor fraction is cooled to 43.3° C. by ambient air in the expander brake compressor aftercooler. Next the fourth vapor fraction is removed as a gaseous, predominately methane and ethane hydrocarbon residue gas product. If desired, the fourth vapor fraction is further compressed to the desired product specifications, by mechanically driven compressors.

In the present embodiment, the temperature of the cooled second vapor fraction is not less than about −45° C., so as not to exceed the lower temperature limit of carbon steel material. Likewise, the temperature of the cooled feed stream is not less than −45° C. In other embodiments the temperatures of these two streams are lower than −45° C. The desired temperatures are dependent on the optimum heat balance, feed stream, or the plant inlet and outlet conditions. In these embodiments, more expensive material, such as stainless steel, is used.

Heat exchange occurs in the first section 22 of the indirect heat exchanger 24, between the feed stream (cooling), the first liquid fraction (heating), the fourth vapor fraction (heating), and the fourth liquid fraction (heating) with all four streams in parallel. Also, heat exchange occurs in the second section 32 of the indirect heat exchanger 24. First heat exchange occurs between the third vapor fraction (cooling), the fourth vapor fraction (heating) and the fourth liquid fraction (heating) in parallel. Second, heat exchange occurs between the second vapor fraction (cooling), the fourth vapor fraction (heating) and the fourth liquid fraction (heating) in parallel. Heat is also exchanged between the feed stream and the fourth liquid fraction, after the fourth liquid fraction has exchanged first with the third vapor fraction, and then with the second vapor fraction.

Variations and modifications can be made to the preferred embodiment of the present invention. For instance, if preferred, the inlet pressure and temperature of the feed stream can vary. However, the pressure is high enough to provide effective cooling of the feed stream (or a portion thereof) as it is expanded across the turbo expander. Also, inlet compression may be employed to feed the plant, if higher feed stream pressure is desired for the process cooling requirements. The expander brake compressor can be configured as a feed stream pre-boost, in lieu of a residue gas recompression configuration. Alternatively external mechanical refrigeration and an indirect chiller can be added to supplement the cooling of the feed stream or other vapor fractions in the process. In the above-described embodiment, the first and second sections of the indirect heat exchanger are incorporated into one plate-fin exchanger. While this is preferable up to a plant capacity of about $7.0\times10^6$ std $m^3/d$, the first and second sections of the indirect heat exchanger of the present invention need not be incorporated into one plate-fin exchanger as described. Also, the direct heat exchanger can be a packed column or a trayed column. Still other variations and modifications are possible and will occur to those of skill in the art. All such variations and modifications are believed to be within the sphere and scope of the present invention.

What is claimed is:

1. A process for recovery of liquefied petroleum gas from a feed stream, the process comprising:

passing said feed stream through an indirect heat exchanger;

separating said feed stream into a first vapor fraction and a first liquid fraction;

transferring said first liquid fraction to said indirect heat exchanger;

transferring said first vapor fraction to a direct heat exchanger absorber column;

transferring said first liquid fraction to a distilling unit;

distilling said first liquid fraction in said distilling unit to yield a second vapor fraction and a second liquid fraction;

cooling said second vapor fraction in said indirect heat exchanger; separating said second vapor fraction into a third vapor fraction and a third liquid fraction;

returning substantially all of said third liquid fraction to said distilling unit;

passing said third vapor fraction through the indirect heat exchanger, at least a portion of said third vapor fraction condensing to a liquid phase;

decreasing pressure of said third vapor fraction such that at least a portion of said liquid phase flashes; transferring said third vapor fraction to said direct heat exchanger absorber column such that said third vapor fraction mixes with said first vapor fraction, yielding a fourth vapor fraction and a fourth liquid fraction;

transferring said fourth liquid fraction to said indirect heat exchanger; transferring said fourth liquid fraction to said distilling unit to distill said fourth liquid fraction; and transferring said fourth vapor fraction to said indirect heat exchanger, such that, the feed stream exchanges heat with the first liquid fraction, the fourth vapor fraction and the fourth liquid fraction, all four streams being in parallel, and the third vapor fraction exchanges heat with the fourth vapor fraction and the fourth liquid fraction, all three streams being in parallel, and the second vapor fraction exchanges heat with the fourth vapor fraction and the fourth liquid fraction, all three streams being in parallel, wherein heat is exchanged between the feed stream and the fourth liquid fraction, after the fourth liquid fraction has exchanged with the third vapor fraction, and then with the second vapor fraction.

2. The process for recovery of liquefied petroleum gas according to claim 1, wherein the second vapor fraction exchanges heat with the fourth vapor fraction, the first liquid fraction and the fourth liquid fraction, all four streams being in parallel.

3. The process for recovery of liquefied petroleum gas according to claim 1, wherein said feed stream exchanges heat with the first liquid fraction, the fourth vapor fraction and the fourth liquid fraction in a first section of said indirect heat exchanger and the third vapor fraction exchanges heat with the fourth vapor fraction and the fourth liquid fraction in a second section of said indirect heat exchanger.

4. The process for recovery of liquefied petroleum gas according to claim 3, wherein said second vapor fraction exchanges heat with the fourth vapor fraction and the fourth liquid fraction in said second section of said indirect heat exchanger.

5. The process for recovery of liquefied petroleum gas according to claim 3, wherein said second vapor fraction exchanges heat with the fourth vapor fraction, the first liquid fraction and the fourth liquid fraction in said first section of said heat exchanger.

6. The process for recovery of liquefied petroleum gas according to claim 1, wherein said distilling unit is a deethanizer.

7. The process for recovery of liquefied petroleum gas according to claim 1, wherein said direct heat exchanger is a packed column or trayed column.

8. The process for recovery of liquefied petroleum gas according to claim 1, wherein said first vapor fraction is expanded in an expander turbine prior to transferring to said direct heat exchanger.

9. The process for recovery of liquefied petroleum gas according to claim 1, wherein said distilling unit is maintained at a substantially higher pressure than said direct heat exchanger.

10. The process for recovery of liquefied petroleum gas according to claim 3, wherein said indirect heat exchanger comprises two indirect heat exchangers, corresponding to said first and second sections.

11. The process for recovery of liquefied petroleum gas according to claim 1, wherein said indirect heat exchanger comprises one plate-fin exchanger.

* * * * *